US006325894B1

(12) United States Patent
Steiner et al.

(10) Patent No.: US 6,325,894 B1
(45) Date of Patent: Dec. 4, 2001

(54) PRESS SECTION AND METHOD OF USING THE SAME

(75) Inventors: Karl Steiner, Herbrechtingen; Albrecht Meinecke, Heidenheim, both of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/231,088

(22) Filed: Jan. 14, 1999

(30) Foreign Application Priority Data

Jan. 21, 1998 (DE) ..... 198 020 54

(51) Int. Cl.[7] ..... D21F 3/04
(52) U.S. Cl. ..... 162/205; 162/358.3; 162/360.3
(58) Field of Search ..... 162/360.2, 360.3, 162/358.3, 205

(56) References Cited

U.S. PATENT DOCUMENTS

| | | | | |
|---|---|---|---|---|
| 58,051 | * | 9/1866 | Bingham | 162/360.3 |
| 3,268,390 | | 8/1966 | Ely, Sr. | 162/360.2 |
| 3,997,391 | * | 12/1976 | Ortolani | 162/360.3 |
| 4,648,942 | | 3/1987 | Wanke et al. | 162/360.3 |
| 4,988,410 | | 1/1991 | Meinecke et al. | 162/360.2 |
| 5,389,205 | * | 2/1995 | Pajula et al. | 162/358.3 |
| 5,404,811 | * | 4/1995 | Schiel et al. | 162/360.3 |
| 5,611,893 | | 3/1997 | Pajula et al. . | |

FOREIGN PATENT DOCUMENTS

| | | | | |
|---|---|---|---|---|
| 3328162 | | 2/1985 | (DE) . | |
| 4321399 | | 11/1993 | (DE) . | |
| 29518748 | | 11/1995 | (DE) . | |
| 29621078 | | 3/1997 | (DE) . | |
| 19633958 | | 10/1997 | (DE) . | |
| 19801417 | | 7/1999 | (DE) . | |
| 19802853 | | 7/1999 | (DE) . | |
| 0487483 | | 5/1992 | (EP) . | |
| 657579 | * | 6/1995 | (EP) | 162/358.3 |
| 98/07923 | | 2/1998 | (WO) . | |

OTHER PUBLICATIONS

Mirsberger "Shoepresses for Intensive Dewatering of Papers and Boards" V. 130–138, Oct. 1989.*

* cited by examiner

*Primary Examiner*—Karen M. Hastings
(74) *Attorney, Agent, or Firm*—Greenblum & Bernstein P.L.C.

(57) ABSTRACT

Press section and method of using the same for drainage of a fibrous material web that includes a shoe press roll, a cylindrical counter roll, at least one nip, a first nip of the at least one nip formed by the shoe press roll and the cylindrical counter roll, and at least one press felt. The at least one press felt is disposed on each side of the fibrous material web. The at least one press felt travels through a last nip of the at least one nip where the at least one press felt is separated from the fibrous material web and conveyed away after leaving the last nip. The drainage capacity and the reliable guidance of the fibrous material web are improved.

6 Claims, 2 Drawing Sheets

PRESS SECTION AND METHOD OF USING THE SAME

CROSS REFERENCE TO RELATED APPLICATIONS

The present application claims priority under 35 U.S.C. §119 of German Patent Application No. 198 020 54.6, filed Jan. 21, 1998, the disclosure of which is expressely incorporated by reference herein in its entirety.

BACKGROUND OF THE INVENTION

1. Field of the Invention

The invention relates to press sections and methods of using the same for drainage of fibrous material webs, and more specifically to press sections with at least two nips.

2. Discussion of Background Information

DE 295 18 748 A1 describes a press section that includes two nips, which are each formed by a shoe press roll in combination with a smooth roll. The paper web is transferred from the wire section of the paper making machine onto an endless, smooth, and flexible pressing belt, which travels together with the paper web through the first nip and transfers the paper web onto the smooth roll of the second nip. In this press section, the guidance of the paper web through the last nip, and in particular after it, causes problems.

SUMMARY OF THE INVENTION

Accordingly, the present invention is directed to a method and device for a press section that substantially obviates one or more of the problems arising from the limitations and disadvantages of the related art.

It is an object of the present invention to provide a press section that assures an improved guidance of the fibrous material web, in particular after the last nip.

It is another object of the present invention to provide a press section with improved drainage capacity, in particular in the last nip.

Accordingly, one aspect of the present invention is directed to a press section for drainage of a fibrous material web that includes a shoe press roll, a cylindrical counter roll, at least one nip, and a first nip of the at least one nip formed by the shoe press roll and the cylindrical counter roll, and at least one press felt. The at least one press felt is disposed on each side of the fibrous material web. The at least one press felt travels through a last nip of the at least one nip, after which the at least one press felt is separated from the fibrous material web an conveyed away after leaving the last nip.

According to another aspect of the present invention, the fibrous material web travels on the shortest possible path to a second cylindrical counter roll of the last nip after winding part way around the cylindrical counter roll of the first nip.

According to yet another aspect of the present invention, the fibrous material web includes a paper web.

In a further aspect of the present invention, the at least one press felt is separated from the fibrous material web by a suction element.

According to another aspect of the present invention, the at least one press felt is separated from the fibrous material web by a blower element.

According to yet another aspect of the present invention, the one at least one press felt disposed on each side of the fibrous material web also travels through the first nip.

In a further aspect of the present invention, the one at least one press felt disposed on each side of the fibrous material web travels through all of our at least one nips.

In still another aspect of the present invention, the at least one press felt travels through all of the at least one nips.

According to yet another aspect of the present invention, the cylindrical counter roll of the first nip and the second cylindrical counter roll of the last nip are pressed at least slightly against each other.

According to a further aspect of the present invention, the last nip is formed by the second cylindrical counter roll and a second shoe press roll.

In another aspect of the present invention, the at least one press felt that carries the fibrous material web after leaving the last nip is conveyed past a suction element.

In accordance with yet another aspect of the present invention, the suction element includes a suction roll.

According to a further aspect of the present invention, the suction element includes a suction box.

According to another aspect of the present invention, the at least one press felt separated from the fibrous material web and conveyed away after leaving the last nip is conveyed past a blower element.

In yet another aspect of the present invention, the blower element includes a blow box.

According to a further aspect of the present invention, the invention includes a method for drainage of a fibrous material that includes: forming a first nip between a first shoe press roll and a first cylindrical roll; forming a second nip between a second shoe press roll and a second cylindrical roll; forming a third nip between the first cylindrical roll and the second cylindrical roll; placing at least one press felt on each side of a fibrous material web; passing the fibrous material web with the at least one press felt on each side through at least one of the first nip, the second nip, and the third nip; separating the press felt from the fibrous material web after the fibrous web material passes through at least one of the first nip, the second nip, and the third nip; and conveying away the at least one press felt separated from the fibrous material web, wherein the drainage capacity and the reliable guidance of the fibrous material web are improved.

In another aspect of the present invention, the third nip is formed by slightly pressing together the first cylindrical roll and the second cylindrical roll.

In yet another aspect of the present invention, the separating includes sucking the at least one press felt from the fibrous material web.

According to a further aspect of the present invention, the separating includes blowing the at least one press felt from the fibrous material web.

According to still another aspect of the present invention, the at least one press felt passes through only the first nip.

In yet another aspect of the present invention, the at least one press felt passes through only the first nip and the second nip.

According to a further aspect of the present invention, the at least one press felt passes through the first nip, the second nip, and the third nip.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

Figure 1:
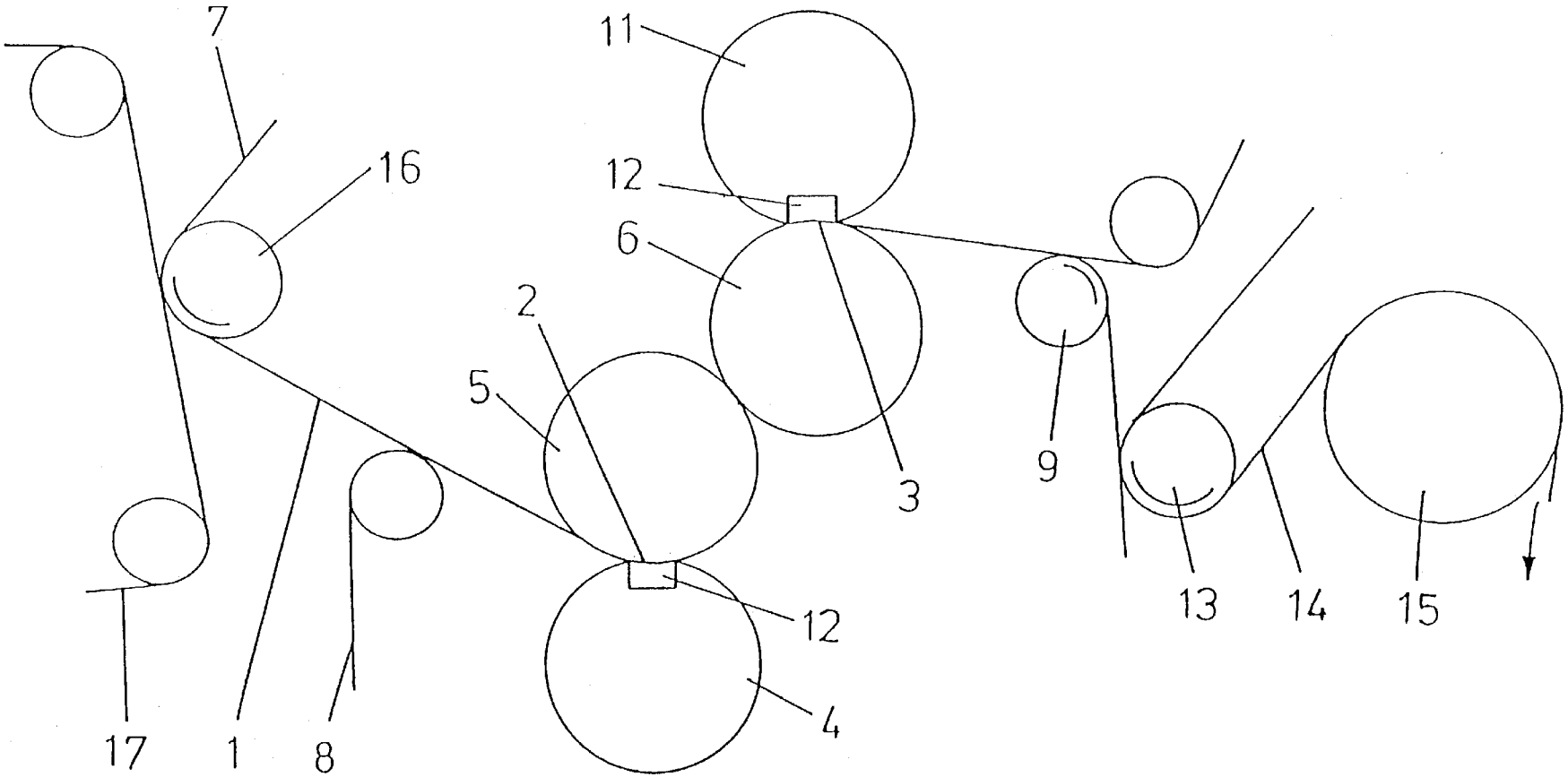
FIG. 1 is a side view of an exemplary press section with a suction roll after the last nip.

The particulars shown herein are by way of example and for purposes of illustrative discussion of the embodiments of the present invention only and are presented in the cause of providing a useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In a press section and method of using the same according to the present invention, at least one press felt, that is disposed on each side of the fibrous material web, travels at least through the last nip. After the last nip, one press felt is separated from the fibrous material web by means of a suction element, or blower element, and is then conveyed away.

As a result, the use of two press felts brings about an improvement of the drainage capacity in the last nip and a reliable guidance of the fibrous material web, after the last nip, along at least one press felt. The rewetting by the one press felt is limited due to the fact that it is conveyed away quickly. To separate the fibrous material web from the press felt, the press felt that has been conveyed away from the fibrous material web after the last nip may be conveyed past a blower element, preferably in the form of a blow box.

In addition to this, it is also possible that the press felt continue to carry the fibrous material web after the last nip may be conveyed past a suction element, preferably in the form of a suction roll or a suction box.

The use of a suction element removes the press felt from the fibrous material web, and also accomplishes removing at least part of the water from the press felt so that the rewetting from the continuing press felt is limited.

The formation of an elongated nip, with the aid of a shoe press roll in the last nip, permits a gentle or intensive drainage of the fibrous material web. Through at least a slight pressing together of the counter rolls of the first and last nip, a further press nip may be produced, which improves the drainage result.

In order to ensure a sufficient water absorption capacity on both sides of the fibrous material web, at least one press felt, that may be disposed on each side of the fibrous material web, should also travel through the first nip and preferably through all of the nips.

A completely reliable and closed guidance of the fibrous material web through the press section is produced when the press felts travel through all of the nips. The fibrous material web may be transferred from the preceding wire section to press felt, and from this, or from the other press felt, to a subsequent unit, for example a drying wire of a drier section. Both transfer procedures are usually facilitated by suction or blower devices.

In the exemplary embodiments of a press section according to the present invention, the press section is comprised of three nips. The first nip 2 and the last nip 3 are shown as being elongated, and are respectively formed by a shoe press roll 4 and a counter roll 5, or a shoe press roll 11 and a counter roll 6. The second nip is formed by the two cylindrical counter rolls 5 and 6 and generally functions with a lower pressing force.

A press felt 7, 8, that is respectively disposed on each side of the fibrous material web 1, travels through all of the nips starting from nip 2 through to nip 3. The press felts 7, 8 absorb the expressed water in nips 2, 3 and guide the fibrous material web 1 through the press section, which makes high speeds possible.

The removal of the fibrous material web 1 from wire 17 of a preceding former is shown by way of example here. The transfer to upper press felt 7 is facilitated by a suction roll 16 that press felt 7 is wound around. After this, lower press felt 8 is supplied.

Figure 2:
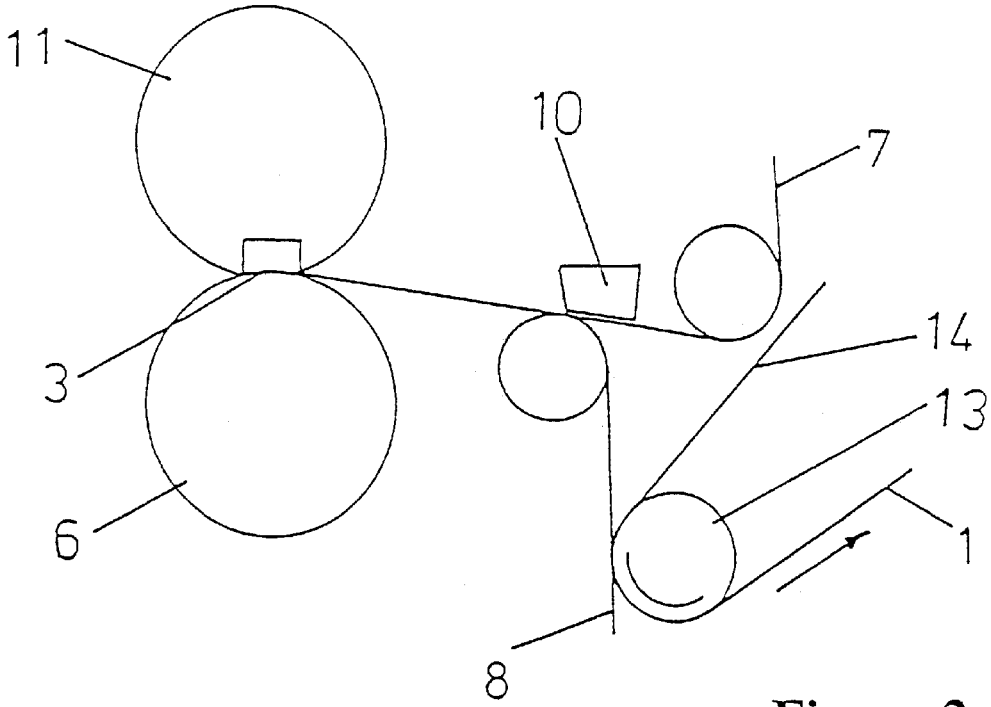
FIG. 2 is a partial side view of an exemplary press section with a last nip and a subsequent blow element.

As shown in FIGS. 1 and 2, after the last nip 3, the upper press felt 7 is conveyed away from the fibrous material web 1 as rapidly as possible so that the rewetting of fibrous material web 1 by press felt 7 is limited. In order to support this procedure, lower press felt 8, in FIG. 1, may be routed via a suction element 9 that may be in the form of a suction roll.

In the course of winding around suction roll 9, lower press felt 8, together with fibrous material web 1, is conveyed away from upper press felt 7. In an embodiment of the present invention shown in FIG. 2, in the region of the separation of press felts 7 and 8, upper press felt 7 is conveyed along a blower element 10 in the form of a blow box, wherein lower press felt 8, together with fibrous material web 1 winds partially around a guide roll that may be opposite blower element 10. The blowing in of air through the upper press felt 7 into the outlet wedge formed between the upper press felt 7 and the fibrous material web 1 assures the removal of fibrous material web 1 from the upper felt 7.

Figure 3:
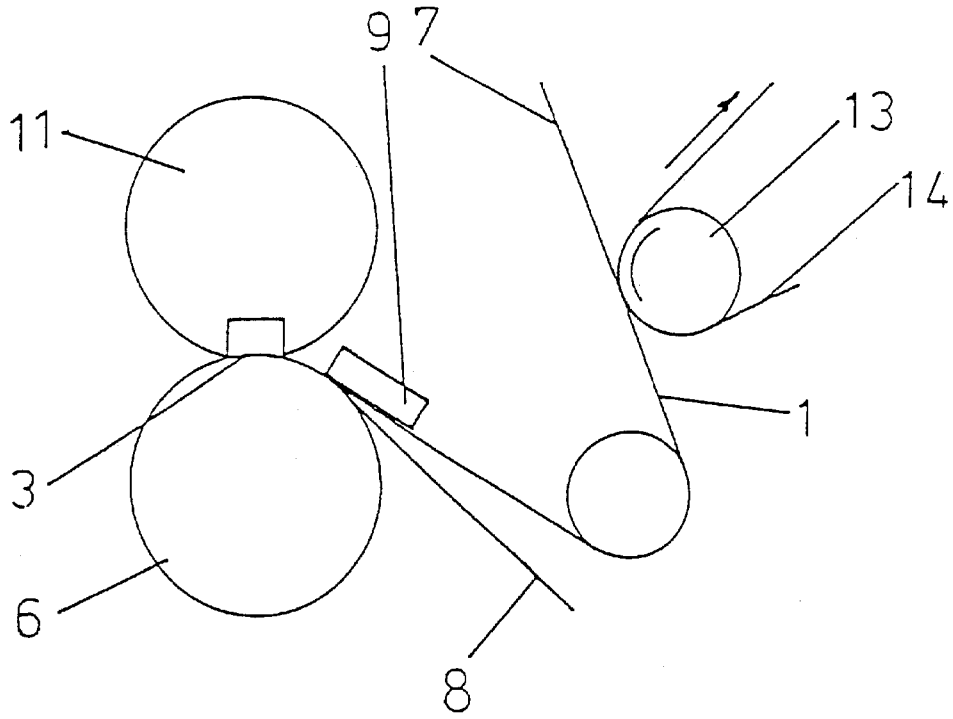
FIG. 3 is a partial side view of an exemplary press section with a last nip and a subsequent suction element.

In an embodiment of the present invention shown in FIG. 3, lower press felt 8 is conveyed away from fibrous material web 1 after the last nip 3. For the sake of support, in the region in which the lower press felt 8 is conveyed away, upper press felt 7 travels along a suction element 9 that may be in the form of a suction box.

The use of suction element 9, furthermore, has the advantage that a part of the water may already be drained from press felts 7 and 8 into suction element 9, which reduces the rewetting by the continuing press felt 7 or 8.

In the exemplary embodiments of a press section according to the present invention, the fibrous material web 1 may be transferred from the continuing press felt 7 or 8 to a drying wire 14 of a subsequent drier section in which the fibrous material web 1 is conveyed by a way of guide rolls and heated drying cylinders 15. Here, too, the transfers are encouraged by a suction roll 13 around which the drying wire 14 winds.

The suction element may be essentially comprised of a perforated roll jacket on the interior of which a vacuum is generated. This occurs either directly by way of a connection to a vacuum source or indirectly by way of a suction of the exterior part of the roll jacket that is not wound around.

The shoe press rolls 4 or 11 may be comprised of a flexible roll jacket that is guided over a press unit 12 that may have a concave pressing surface. The pressing may occur in a hydraulic fashion and the lubrication between the roll jacket and the pressing surface may occur in a hydrostatic and/or hydrodynamic fashion.

The cylindrical counter rolls 5 and 6 may be embodied as coated, grooved, or blind bored.

It is noted that the foregoing examples have been provided merely for the purpose of explanation and are in no way by construed as limiting of the present invention. While the present invention has been described with reference to a preferred embodiment, it is understood that the words which have been used herein are words of description and illustration, rather than words of limitation. Changes may be made within the purview of the appended claims, as presently stated and as amended, without departing from the scope and spirit of the present invention in its aspects. Although the present invention has been described herein with reference to particular means, materials, and embodiments, the present invention is not intended to be limited to the particulars disclosed herein; rather, the present invention extends to all functionally equivalent structures, methods and uses, such as are within the scope of the appended claims.

What is claimed is:

1. A method for drainage of a fibrous material comprising:

forming a first nip between a first shoe press roll and a first cylindrical roll;

forming a second nip between a second shoe press roll and a second cylindrical roll;

forming a third nip between the first cylindrical roll and the second cylindrical roll;

placing at least one press felt on each side of a fibrous material web;

passing the fibrous material web with the at least one press felt on each side through at least one of the first nip, the second nip, and the third nip, and wherein the fibrous material web is always in contact with at least one of the at least one press felts as it is guided from a first one of the first, second, and third nips to a last one of the first, second, and third nips;

separating the at least one press felt on one side of the fibrous material web from the fibrous material web after the fibrous web material passes through the second nip; and conveying away the at least one press felt separated from the one side of the fibrous material web, wherein the drainage capacity and the reliable guidance of the fibrous material web are improved.

2. The method according to claim 1, the third nip formed by pressing together the first cylindrical roll and the second cylindrical roll with a force lower than that in the first and second nips.

3. The method according to claim 1, the separating comprising sucking the at least one press felt from the fibrous material web.

4. The method according to claim 1, the separating comprising blowing the at least one press felt from the fibrous material web.

5. The method according to claim 1, passing the at least one press felt on each side of the fibrous material web through the first nip, the second nip, and the third nip.

6. A method of using the press section that includes a first and a second shoe press roll, a first and a second cylindrical counter roll, at least two nips which include a first nip formed by the first shoe press roll and the first cylindrical counter roll and a second nip formed by the first and second cylindrical counter rolls, a third nip formed by the second shoe press roll and the second cylindrical counter roll, and at least two press felts, the process comprising:

forming the first nip between the first shoe press roll and the first cylindrical counter roll;

forming the second nip between the first cylindrical counter roll and the second cylindrical counter roll;

forming the third nip between the second shoe press roll and the second cylindrical counter roll;

placing at least one of the at least two press felts on each side of a fibrous material web;

passing the fibrous material web with the at least one press felt on each side through at least one of the first nip, the second nip, and the third nip, and wherein the fibrous material web is always in contact with at least one of the at least one press felts as it is guided from the first, second, and third nips;

separating the at least one press felt on one side of the fibrous material web from the fibrous material web after the fibrous web material passes through the third nip; and conveying away the at least one press felt separated from the one side of the fibrous material web, wherein the drainage capacity and the reliable guidance of the fibrous material web are improved.

* * * * *